US010016770B2

(12) United States Patent
Yamasaki et al.

(10) Patent No.: US 10,016,770 B2
(45) Date of Patent: Jul. 10, 2018

(54) ROTARY ATOMIZING ELECTROSTATIC APPLICATOR AND SHAPING AIR RING FOR THE SAME

(71) Applicants: TOYOTA JIDOSHA KABUSHIKI KAISHA, Toyota-shi, Aichi-ken (JP); Ransburg Industrial Finishing K.K., Kanagawa (JP)

(72) Inventors: Isamu Yamasaki, Toyota (JP); Shunya Kobayashi, Toyota (JP); Michio Mitsui, Kanagawa (JP); Osamu Yoshida, Kanagawa (JP); Yoshiharu Yokomizo, Kanagawa (JP)

(73) Assignees: Toyota Jidosha Kabushiki Kaisha, Aichi-ken (JP); Ransburg Industrial Finishing K.K., Kanagawa (JP)

( * ) Notice: Subject to any disclaimer, the term of this patent is extended or adjusted under 35 U.S.C. 154(b) by 219 days.

(21) Appl. No.: 15/041,138

(22) Filed: Feb. 11, 2016

(65) Prior Publication Data

US 2016/0236214 A1 Aug. 18, 2016

(30) Foreign Application Priority Data

Feb. 16, 2015 (JP) ..... 2015-027242

(51) Int. Cl.
*B05B 3/00* (2006.01)
*B05B 5/04* (2006.01)
(Continued)

(52) U.S. Cl.
CPC ..... *B05B 5/0407* (2013.01); *B05B 3/1092* (2013.01); *B05B 5/03* (2013.01); *B05B 5/0426* (2013.01)

(58) Field of Classification Search
CPC ..... B05B 5/04; B05B 5/0407; B05B 7/0815; B05B 3/02; B05B 3/1014; B05B 3/1064; B05B 3/1092
(Continued)

(56) References Cited

U.S. PATENT DOCUMENTS 6,899,279 B2 * 5/2005 Seitz ..... B05B 5/0407 239/104
9,295,999 B2 3/2016 Yamasaki et al.
(Continued)

FOREIGN PATENT DOCUMENTS

EP 2058053 A1 5/2009
EP 2614895 A1 7/2013
(Continued)

OTHER PUBLICATIONS

Extended European Search Report issued in corresponding European Patent Application No. 16155743.4 dated Jun. 21, 2016 (7 pages).
(Continued)

*Primary Examiner* — Steven J Ganey
*Assistant Examiner* — Viet Le
(74) *Attorney, Agent, or Firm* — Kilyk & Bowersox, P.L.L.C.

(57) ABSTRACT

The present invention solves a problem of a trade-off between increases in paint discharge rate and maintenance of painting quality. A rotary atomizing electrostatic applicator includes a bell cup 10 whose back 10*a* is hit by atomization air SA-IN at an angle of 90 degrees or less; and first air holes 30 adapted to discharge the atomization air SA-IN directed at the back 10*a* of the bell cup, wherein the first air holes 30 are arranged at equal intervals on a circumference centered around a rotation axis of the bell cup 10, the first air holes 30 are oriented in a direction opposite to a rotation direction of the bell cup 10; and the atomization air SA-IN discharged through the first air holes 30 is twisted in the direction opposite to the rotation direction of the bell cup 10 at an angle of 50 degrees or more and less than 60 degrees.

19 Claims, 14 Drawing Sheets

(51) Int. Cl.
*B05B 3/10* (2006.01)
*B05B 5/03* (2006.01)

(58) Field of Classification Search
USPC ..... 239/223, 224, 703
See application file for complete search history.

(56) References Cited

U.S. PATENT DOCUMENTS

| | | | | |
|---|---|---|---|---|
| 2007/0262170 | A1 | 11/2007 | Nolte et al. | |
| 2011/0086166 | A1 | 4/2011 | Fischer et al. | |
| 2013/0040064 | A1 | 2/2013 | Shigekura et al. | |
| 2013/0206874 | A1* | 8/2013 | Yamasaki ..... | B05B 5/0407 239/703 |

FOREIGN PATENT DOCUMENTS

| | | | |
|---|---|---|---|
| JP | H03-101858 | A | 4/1991 |
| JP | H06-114321 | A | 4/1994 |
| JP | H08-084941 | A | 4/1996 |
| JP | H08-099052 | A | 4/1996 |
| JP | 2003-236417 | A | 8/2003 |
| JP | 2007-296520 | A | 11/2007 |
| JP | 2011524801 | A | 9/2011 |
| JP | 2012-115736 | A | 6/2012 |
| JP | 5552537 | B2 | 5/2014 |
| WO | 2009112932 | A1 | 9/2009 |

OTHER PUBLICATIONS

Office Action (English translation) received in corresponding Japanese Patent Application No. JP2015-027242 dated Nov. 22, 2016 (13 pages).

* cited by examiner

200cc/min , SA-OUT ; 0MPa (1)

(2)

(3)

(4)

200cc/min , SA-IN : 0.05MPa (1)

(2)

(3)

ROTARY ATOMIZING ELECTROSTATIC APPLICATOR AND SHAPING AIR RING FOR THE SAME

BACKGROUND OF THE INVENTION

The present invention relates to a rotary atomizing electrostatic applicator and a shaping air ring for the applicator.

High quality is required of automotive body painting, which is connected directly to design and marketability of the automobile. An electrostatic applicator has long been adopted for automotive body painting. The electrostatic applicator continues evolving to answer demands of the automotive industry. The demands roughly fall into two categories. One of the categories asks for further reduction in amounts of wasted paint, i.e., further improvement of coating efficiency. The other category asks for quality improvement of painting. In conventional approaches to quality improvement of metallic painting regarded as important in the quality improvement of painting, a technique which uses strong shaping air has been adopted for many years.

The applicator adapted most often in the automotive industry is a rotary atomizing electrostatic applicator equipped with a cup shaped rotary atomizing head called a "bell cup." Hereinafter the rotary atomizing head will be referred to as a "bell cup." A basic idea about atomization in the rotary atomizing electrostatic applicator has already been established. The idea is based on Equation 1 below.

$$P^3=A\times(Q\mu/\rho N^2r^2) \quad \text{[Equation 1]}$$

where

P: Diameter of paint particle (mm)

A: Coefficient

Q: Feed rate of paint, i.e., amount of paint fed to bell cup (cc/min)

μ: Viscosity (Cp) of paint

ρ: Specific gravity of paint

N: Rotational speed of bell cup (rpm)

r: Radius of bell cup

The following can be seen from Equation 1 above. That is, paint particle diameter P is proportional to the amount Q of paint fed to the bell cup, i.e., the paint discharge rate of the applicator. In other words, Equation 1 teaches that the paint particle diameter P increases with increases in the paint discharge rate.

Next, volume V of a paint particle is given by Equation 2 below.

$$V=(4/3)\times\pi\times(P/2)^3=(1/6)\pi P^3 \quad \text{[Equation 2]}$$

Substituting Equation 1 into Equation 2 yields Equation 3 below.

$$V=(\pi/6)\times A\times Q\times\mu\times(1/\rho N^2r^2) \quad \text{[Equation 3]}$$

In Equation 3, {(π/6)×A} is a constant. When {(π/6)×A} is substituted with "B," Equation 3 can be expressed by Equation 4 below.

$$V=(B\times Q\times\mu)/(\rho N^2r^2) \quad \text{[Equation 4]}$$

The following can be seen from Equation 4. That is, the volume V of the paint particle is inversely proportional to the square of the rotational speed (bell revolution) N of the bell cup. The volume V of the paint particle is also inversely proportional to the square of the radius r of the bell cup. In other words, Equation 4 teaches that increasing the rotational speed N of the bell cup is effective in decreasing the volume V of the paint particle. Also, Equation 4 teaches that increasing the radius r of the bell cup is effective in decreasing the volume V of the paint particle.

Based on instructions given by Equations 1 and 4, a technique which involves increasing the rotational speed of the bell cup and/or increasing the radius of the bell cup has conventionally been adopted as a technique for increasing atomization, i.e., decreasing the paint particle size.

It is known that to improve the quality of metallic painting, the velocity of collision of paint particles with automotive body surface can be increased. Based on this idea, an electrostatic applicator applicable to metallic painting has been developed. The electrostatic applicator is called a "metal bell" in the industry (Japanese Patent Laid-Open No. 3-101858).

The metal bell adopts a configuration in which the shaping air is directed at the back or outer circumferential edge of the bell cup. The shaping air of the metal bell is assigned two roles: the role of (a) atomizing the paint and (b) directing the paint particles at a workpiece and defining a painting pattern. To enhance the function (b) of defining the painting pattern, an electrostatic applicator has been developed which twists the shaping air in a direction opposite to the rotation direction of the bell cup (Japanese Patent Laid-Open No. 2012-115736). Japanese Patent Laid-Open No. 2012-115736 proposes to control a painting pattern width by discharging additional shaping air forward on a radially outer side of the shaping air while controlling discharge pressure or flow rate of the additional shaping air.

Incidentally, a painting process in which the electrostatic applicator is installed makes up part of an automotive production line. That is, the automotive production line includes a pressing process, a welding process, the painting process, and an assembly process.

Currently, the electrostatic applicator installed in the automotive production line is operated using, for example, the following parameters.

(i) Rotational speed of the bell cup: 20,000 to 30,000 rpm (ii) Paint discharge rate: 200 to 300 cc/min (iii) Twist angle of shaping air: 30 to 45 degrees (iv) Diameter of bell cup: 77 mm (v) Discharge pressure of shaping air: 0.10 to 0.15 MPa (vi) Flow rate of shaping air; 500 to 650 NL/min (vii) Painting pattern width: 300 to 350 mm in diameter (viii) Coating efficiency: approximately 60 to 70%

Here, the above-mentioned twist angle of shaping air means the twist angle of the shaping air directed at the back or outer circumferential edge of the bell cup.

In the case of metallic painting, which uses strong shaping air (0.20 MPa, 650 NL/min), the coating efficiency is approximately 10% lower than non-metallic, i.e., solid painting. The painting pattern width is approximately 320 mm in diameter.

Note that the diameter of the bell cup is 70 mm or 65 mm depending on the applicator maker. The bell cups of these sizes are used to paint outer plates of automotive bodies. To paint bumpers or small parts, an electrostatic applicator equipped with a bell cup of 30 mm, 40 mm, or 50 mm in diameter is used. The rotational speed of the bell cup may be higher than 30,000 rpm.

When the amount of paint discharged by the electrostatic applicator is increased, it is necessary to keep film thickness constant by increasing the coating speed. For example, when the paint discharge rate is doubled compared to a conventional one, if the film thickness is kept at a conventional level by doubling the coating speed, the number of applicators can be reduced. In other words, if the same number of applicators as before is used, the time required for the painting process can be reduced. Therefore, if the paint discharge rate of the electrostatic applicator can be increased from, for example, the current level of 200 to 300 cc/min to, for example, 500 cc/min or 1,000 cc/min, this can contribute greatly to improvement in the production capacity of the automotive production line. However, things are not so simple as to be able to merely increase the paint discharge rate of the rotary atomizing electrostatic applicator. Increasing the paint discharge rate increases the diameter of the paint particles, making it difficult to maintain painting quality. That is, the paint discharge rate and painting quality are in a trade-off relation to each other.

The problem of the trade-off causes the following problems when a conventional technique is adopted for atomization of paint. The conventional technique involves increasing the rotational speed of the bell cup (bell revolution) and/or the diameter of the bell cup based on the instructions given by Equations 1 and 4 described above.

(1) Problems Involved in Setting the Rotational Speed of the Bell Cup High:

(1-1) Reduction in Coating Efficiency:

A centrifugal force acts on the paint particles flying out of the rotating bell cup. The centrifugal force increases with increases in the rotational speed. With increases in the centrifugal force, it becomes increasingly necessary to raise the discharge pressure or flow rate of shaping air in order to deflect the paint particles toward the workpiece against the centrifugal force. However, if the shaping air is intensified, the paint particles hit a workpiece surface at higher velocity and the shaping air bounces off the workpiece. As the shaping air bounces off, the paint particles are blown off before attaching to the workpiece surface. Thus, there is a problem in that intensifying the shaping air leads to a fall in the coating efficiency.

(1-2) Double Pattern:

If the shaping air is intensified, the painting pattern is prone to be doubled. The double pattern refers to a condition in which due to differences in the weight of paint particles, small paint particles (light particles) gather in a center portion of the painting pattern while large paint particles (heavy particles) gather in an outer circumferential part. When a double painting pattern is produced, a paint film tends to become relatively thick in the center portion and relatively thin in the outer circumferential portion. Consequently, with the double painting pattern, there is a problem in that paint film thickness is prone to become ununiform.

(2) Problems with a Large-Diameter Bell Cup:

(2-1) Overspray:

Adoption of a large-diameter bell cup increases the painting pattern width, i.e., painting pattern diameter. When the painting pattern width is increased, in order to implement a painted surface of uniform film thickness in forming a paint film, for example, by reciprocating motion of the applicator, it is necessary to overspray half the circular painting pattern. This means increases in the amount of paint wasted by the overspray.

(2-2) Centrifugal Force Acting on Paint Particles:

At equal rotational speed, a bell cup with a large radius has a higher circumferential velocity than a bell cup with a small radius. Thus, when a bell cup with a large radius is adopted, a large centrifugal force acts on the paint particles flying out of the bell cup. The problems encountered when a large centrifugal force acts on paint particles are as described above.

SUMMARY OF THE INVENTION

A major object of the present invention is to provide a rotary atomizing electrostatic applicator and a shaping air ring for the applicator, where the applicator and shaping air ring can solve the above-mentioned problem of the trade-off between the increases in paint discharge rate and maintenance of painting quality.

Another object of the present invention is to provide a rotary atomizing electrostatic applicator and a shaping air ring for the applicator, where the applicator and shaping air ring can solve the above-mentioned problem of the trade-off between the paint discharge rate and painting quality by simply replacing the shaping air ring and a bell cup which are relatively easy to replace.

A still another object of the present invention is to provide a rotary atomizing electrostatic applicator and a shaping air ring for the applicator, where the applicator and shaping air ring can increase coating efficiency.

In view of the technical problems described above, the present inventors built a prototype model by paying attention to the twist angle of the shaping air to be applied to the back of a bell cup and verified data. The present inventors propose the present invention based on the verification achieved using the prototype model.

According to the present invention, the technical problems described above are solved basically by providing a rotary atomizing electrostatic applicator comprising:

a bell cup whose back is hit by atomization air at an angle of 90 degrees or less; and first air holes adapted to discharge the atomization air directed at the back of the bell cup, wherein the first air holes are arranged at equal intervals on a circumference centered around a rotation axis of the bell cup, the first air holes are oriented in a direction opposite to a rotation direction of the bell cup, and the atomization air discharged through the first air holes (30) is twisted in the direction opposite to the rotation direction of the bell cup at an angle of 50 degrees or more and less than 60 degrees.

FIGS. 1 to 3 are schematic diagrams showing a tip portion of a prototyped rotary atomizing electrostatic applicator. In FIGS. 1 to 3, reference numeral 10 denotes a bell cup and reference numeral 12 denotes a shaping air ring including air holes that discharge shaping air SA-IN. A back angle of the bell cup 10 illustrated in FIG. 1 is 60 degrees. Here, the back angle of the bell cup 10 refers to an angle of the back 10*a* of the bell cup 10 with respect to a plane of an outer circumferential edge of the bell cup 10. The bell cup 10 illustrated in FIG. 2 has a back angle of 75 degrees. The bell cup 10 illustrated in FIG. 3 has a back angle of 90 degrees. A diameter of the bell cup 10 is 77 mm.

In FIGS. 1 to 3, to distinguish among three types of bell cup 10 differing in the back angle, a bell cup with a back angle of 60 degrees is denoted by a reference numeral 10(60) (FIG. 1), a bell cup with a back angle of 75 degrees is denoted by a reference numeral 10(75) (FIG. 2), and a bell cup with a back angle of 90 degrees is denoted by a reference numeral 10(90) (FIG. 3).

The bell cups 10 in FIGS. 1 to 3 have first air holes of 0.7 mm in diameter to discharge atomization air, i.e., shaping air SA-IN. In order to ensure consistency among data obtained from three types of rotary atomizing electrostatic applicator illustrated in FIGS. 1 to 3, the number of the first air holes in each bell cup 10 is 52. Painting conditions were as follows.

(1) High voltage: −80 kV (2) Paint discharge rate: 600 cc/min, which was approximately 2 times the conventional rate (3) Rotational speed of bell cup: 25,000 rpm (4) Painting speed (gun speed): 350 mm/sec (5) Painting distance (gun distance): 200 mm In the following description, the twist angle of the atomization air, i.e., the shaping air SA-IN, means a twist angle in the direction opposite to the rotation direction of the bell cup.

TABLE 1

(back angle of bell cup 60° (FIG. 1) & twist angle 50°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | 660 | 85.7 | 11.75 | 23.06 | 61.20 | 21.07 |
| 0.1 | 400 | not measured | not measured | 11.81 | 23.53 | 57.70 | 21.13 |
| 0.15 | 500 | 600 | 83.8 | 11.72 | 22.43 | 51.11 | 20.33 |
| 0.2 | 610 | not measured | not measured | 11.61 | 21.95 | 50.67 | 20.03 |

TABLE 2

(back angle of bell cup 60° (FIG. 1) & twist angle 55°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | 730 | 83.7 | 11.85 | 23.54 | 63.34 | 21.44 |
| 0.1 | 400 | not measured | not measured | 11.54 | 21.82 | 57.82 | 20.23 |
| 0.15 | 500 | 620 | 83.7 | 11.77 | 22.39 | 53.97 | 20.51 |
| 0.2 | 610 | not measured | not measured | 12.04 | 24.05 | 54.30 | 21.41 |

TABLE 3

(back angle of bell cup 60° (FIG. 1) & twist angle 60°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | unmeasurable | unmeasurable | unmeasurable | unmeasurable | unmeasurable | unmeasurable |
| 0.1 | 400 | unmeasurable | unmeasurable | unmeasurable | unmeasurable | unmeasurable | unmeasurable |
| 0.15 | 500 | unmeasurable | unmeasurable | unmeasurable | unmeasurable | unmeasurable | unmeasurable |
| 0.2 | 610 | unmeasurable | unmeasurable | unmeasurable | unmeasurable | unmeasurable | unmeasurable |

TABLE 4

(back angle of bell cup 75° (FIG. 2) & twist angle 50°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | 610 | 82.7 | 12.04 | 24.55 | 60.99 | 21.88 |
| 0.1 | 400 | not measured | not measured | 12.24 | 27.71 | 59.69 | 22.99 |
| 0.15 | 500 | 540 | 83 | 12.27 | 25.68 | 55.02 | 22.22 |
| 0.2 | 610 | not measured | not measured | 11.86 | 23.49 | 52.58 | 20.94 |

TABLE 5

(back angle of bell cup 75° (FIG. 2) & twist angle 55°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | not measured | not measured | 12.11 | 25.38 | 64.66 | 22.40 |
| 0.1 | 400 | not measured | not measured | 12.28 | 25.10 | 60.45 | 22.31 |
| 0.15 | 500 | not measured | not measured | 12.29 | 25.21 | 56.43 | 22.15 |
| 0.2 | 610 | not measured | not measured | 12.32 | 26.50 | 57.65 | 22.65 |

TABLE 6

(back angle of bell cup 75° (FIG. 2) & twist angle 60°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | unmeasurable | unmeasurable | unmeasurable | unmeasurable | unmeasurable | unmeasurable |
| 0.1 | 400 | unmeasurable | unmeasurable | unmeasurable | unmeasurable | unmeasurable | unmeasurable |
| 0.15 | 500 | unmeasurable | unmeasurable | unmeasurable | unmeasurable | unmeasurable | unmeasurable |
| 0.2 | 610 | unmeasurable | unmeasurable | unmeasurable | unmeasurable | unmeasurable | unmeasurable |

TABLE 7

(back angle of bell cup 90° (FIG. 3) & twist angle 50°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | 610 | 83.5 | 12.40 | 25.50 | 58.83 | 22.50 |
| 0.1 | 400 | not measured | not measured | 12.24 | 26.19 | 56.82 | 22.43 |
| 0.15 | 500 | 490 | 85 | 12.44 | 26.03 | 56.23 | 22.54 |
| 0.2 | 610 | not measured | not measured | 12.54 | 26.26 | 56.19 | 22.74 |

TABLE 8

(back angle of bell cup 90° (FIG. 3) & twist angle 55°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | not measured | not measured | 12.46 | 25.66 | 64.68 | 22.91 |
| 0.1 | 400 | not measured | not measured | 12.79 | 26.82 | 60.63 | 23.42 |
| 0.15 | 500 | not measured | not measured | 12.88 | 27.63 | 59.19 | 23.69 |
| 0.2 | 610 | not measured | not measured | 12.65 | 27.88 | 59.60 | 23.51 |

TABLE 9

(back angle of bell cup 90° (FIG. 3) & twist angle 60°)

| SA-IN air pressure (MPa) | SA-IN flow rate (NL/min) | paint pattern width (mm) | coating efficiency (%) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|---|---|
| 0.06 | 300 | not measured | not measured | 12.68 | 27.16 | 68.52 | 23.77 |
| 0.1 | 400 | not measured | not measured | 13.10 | 28.32 | 64.19 | 24.38 |
| 0.15 | 500 | not measured | not measured | 13.07 | 27.76 | 59.74 | 23.93 |
| 0.2 | 610 | not measured | not measured | 12.99 | 29.31 | 62.62 | 24.43 |

In Tables 1 to 9 above, the value "11.75 μm" (Table 1) at "d10" means that 10% of all particles are 11.75 μm or less in particle diameter. The value "23.06 μm" (Table 1) at "d50" means that 50% of all particles are 23.06 μm or less in particle diameter. The value "61.20 μm" (Table 1) at "d90" means that 90% of all particles are 61.20 μm or less in particle diameter. Similarly, the value of "Sauter mean diameter", such as "21.07 μm" (Table 1), means a value obtained by dividing the total volume by the total area, of all particles. The "Sauter mean diameter" is derived from Equation 5 below, assuming that the number of particles with a particle diameter of $X_i$ is $n_i$.

$$\bar{x} = \frac{\Sigma n_i x_i^3}{\Sigma n_i x_i^2} \quad \text{[Equation 5]}$$

In Tables 1 to 9 above, the present inventors considered a relationship between the twist angle and atomization by paying attention to the fact that even though the paint discharge rate was 600 cc/min, which was approximately twice the conventional value, the diameter of the paint particles showed extremely good values.

FIGS. 4 and 5 are diagrams for illustrating a relationship between the back 10*a* of the bell cup 10 and the twist angle of the atomization air, i.e., the shaping air SA-IN, directed at the back 10*a*. FIGS. 4(I) and 4(II) show an example in which the twist angle of the shaping air SA-IN is 0° (zero). FIG. 4(I) is a side view of the bell cup. FIG. 4(II) is a sectional view of the bell cup taken along the shaping air SA-IN. In FIG. 4(II), an apparent angle of an outer circumferential portion of the bell cup 10 is denoted by An(a). An incident angle of the shaping air SA-IN directed at a point P of the bell cup 10 is denoted by $\theta_0$.

FIGS. 5(I) and 5(II) show an example in which the twist angle of the shaping air SA-IN is β. FIG. 5(I) is a side view of the bell cup, in which arrow R indicates a rotation direction of the bell cup 10. FIG. 5(II) is a sectional view of the bell cup taken along the shaping air SA-IN.

As can be seen from FIG. 5(I), the shaping air SA-IN with a twist angle of β is incident upon the back 10*a* of the bell cup 10 in an inclined state, where the term "inclined" means being inclined with respect to a rotation axis Ax of the bell cup 10.

FIG. 5(II) is a sectional view taken along the shaping air SA-IN as with FIG. 4(II) described above. In other words, FIG. 5(II) is a view obtained by cutting the bell cup 10 obliquely. When the shaping air SA-IN has a twist angle β, the apparent angle An(a) of the outer circumferential portion of the bell cup 10 is smaller than when the twist angle is zero (FIG. 4(II)). Consequently, the incident angle $\theta_1$ (FIG. 5(II)) of the shaping air SA-IN with respect to the bell cup 10 is smaller than when the twist angle is zero (FIG. 4(II)) ($\theta_1<\theta_0$).

When the shaping air SA-IN has a twist angle β, the larger the twist angle β, the smaller the incident angle $\theta_1$ of the shaping air SA-IN with respect to the bell cup 10. A relationship between the twist angle β and incident angle $\theta_1$ was calculated on a trial basis, and resulting numeric values are as follows.

(1) Twist angle β=55° . . . incident angle $\theta_1$=18.49°;
(2) Twist angle β=56° . . . incident angle $\theta_1$=18.07°;
(3) Twist angle β=57° . . . incident angle $\theta_1$=17.64°;
(4) Twist angle β=58° . . . incident angle $\theta_1$=17.21°;
(5) Twist angle β=59° . . . incident angle $\theta_1$=16.77°;
(6) Twist angle β=60° . . . incident angle $\theta_1$=16.32°.

The relationship between the twist angle β of the shaping air and incident angle $\theta_1$ of the shaping air SA-IN with respect to the bell cup 10 teaches the following in considering atomization of paint particles.

As described above, the larger the twist angle β of the shaping air SA-IN, the smaller the incident angle $\theta_1$ of the shaping air SA-IN (FIG. 5(II)). In other words, the larger the twist angle β, the smaller a reflection angle of the shaping air SA-IN reflected off the back 10*a* of the bell cup.

This means that the smaller the reflection angle of the shaping air SA-IN, the closer an arrival point of the shaping air SA-IN reflected off the back 10*a* of the bell cup will be to the outer circumferential edge of the bell cup 10.

Liquid threads of the paint extend from the outer circumferential edge of the bell cup 10. Then, the paint leaving from tips of the liquid threads form the paint particles. When directed at a neighborhood of the outer circumferential edge of the bell cup 10, the atomization air, i.e., the shaping air SA-IN, can contribute to cutting the liquid threads. This means that the paint particles can be further atomized. Then, as the shaping air SA-IN has the twist angle β in the direction opposite to the rotation direction of the bell cup 10, the shaping air SA-IN can cut the liquid threads more effectively than when the shaping air SA-IN has a twist angle in the same direction as the rotation direction of the bell cup 10. This means a higher degree of atomization.

For atomization of the paint, in addition to two techniques adopted conventionally, namely, (1) a technique which involves increasing the rotational speed of the bell cup and (2) a technique which involves increasing the diameter of the bell cup, the present invention can propose a technique which involves increasing the twist angle of the shaping air. The technique which increases the twist angle is independent of the rotational speed and diameter of the bell cup and has no correlation therewith. This makes it possible to further atomize paint particles using a combination of the twist angle and/or the bell cup's rotational speed.

Referring back to Tables 1 to 9, even though the paint discharge rate is 600 cc/min, which is approximately twice the conventional value, the diameter of the paint particles shows extremely good values. This can be understood well based on the viewpoint of cutting the liquid threads effectively described with reference to FIG. 5.

Next, the inventors paid attention to a phenomenon observed when data on the prototype models of Tables 3 and 6 were collected. The prototype model of Table 3 and prototype model of Table 6 were common in that the twist angle β was 60 degrees. With the prototype models of Tables 3 and 6, paint particles flowed back toward the bell cup 10 without flowing forward.

This phenomenon means that in an ambient environment, the atomization air, i.e., the shaping air SA-IN with a twist angle β of 60 degrees produces a practically zero or negative force tending to direct paint particles forward. In other words, the shaping air SA-IN with the twist angle β of 60 degrees causes paint particles to flow backward even if an excellent effect of cutting the liquid threads described above is provided.

The inventors paid attention to this point. As has already been described above, the twist angle β, when set at a value of 50 degrees or more, can contribute to atomization of paint particles. However, when the twist angle β becomes 60 degrees, the force tending to direct paint particles forward becomes zero. This means that when the twist angle β is at or a little below 60 degrees, the force of directing paint particles forward is feeble. That is, it can be said that if the twist angle β is set at or a little below 60 degrees, the force of the shaping air SA-IN can be used for the atomization of paint particles to the maximum extent.

The twist angle β at which the force tending to direct paint particles forward becomes zero varies with the discharge pressure of the shaping air SA-IN and other parameters. If the twist angle β at which the force tending to direct paint particles forward becomes zero is found experimentally and an electrostatic applicator is built with the twist angle of the shaping air SA-IN set to this value, theoretically the shaping air SA-IN can utilize its entire force for the atomization of paint particles. In other words, the force of the shaping air SA-IN tending to direct paint particles forward is reduced to zero. That is, the function of the shaping air SA-IN can be specialized in the atomization of paint particles.

To look for an optimum value of the twist angle β of the shaping air SA-IN at or a little below 60 degrees, prototype models with twist angles of 55 degrees, 56 degrees, 57 degrees, 58 degrees, 59 degrees, and 60 degrees were built. In these prototype models, the diameter of the bell cup 10 was 77 mm and the back angle was 60 degrees. Also, 52 holes of 0.7 mm in diameter were provided to discharge the shaping air SA-IN. Painting conditions were as follows.

(1) High voltage: −80 kV
(2) Paint discharge rate (flow rate): 600 cc/min
(3) Rotational speed of bell cup: 25,000 rpm
(4) Painting speed (gun speed): 350 mm/sec
(5) Painting distance (gun distance): 200 mm

TABLE 10

(twist angle 55°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | 11.17 | 26.76 | 69.36 | 21.50 | 87.6 |
| 0.1 | 400 | 10.68 | 26.38 | 65.36 | 20.70 | — |
| 0.15 | 500 | 10.40 | 26.50 | 60.03 | 20.26 | 86.4 |
| 0.2 | 610 | 10.41 | 27.30 | 59.32 | 20.46 | — |

TABLE 11

(twist angle 56°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | 11.34 | 29.44 | 70.60 | 22.46 | 87.7 |
| 0.1 | 400 | 10.12 | 24.11 | 61.82 | 19.43 | — |
| 0.15 | 500 | 9.80 | 23.11 | 58.18 | 18.68 | 87.0 |
| 0.2 | 610 | 9.49 | 22.17 | 53.57 | 17.93 | — |

TABLE 12

(twist angle 57°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | 11.40 | 29.24 | 70.80 | 22.51 | 88.2 |
| 0.1 | 400 | 10.03 | 23.10 | 59.55 | 18.96 | — |
| 0.15 | 500 | 9.57 | 21.82 | 55.24 | 17.96 | 87.6 |
| 0.2 | 610 | 9.49 | 21.94 | 55.25 | 17.90 | — |

TABLE 13

(twist angle 58°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | 11.16 | 27.47 | 68.03 | 21.62 | 87.6 |
| 0.1 | 400 | 10.03 | 24.06 | 60.57 | 19.26 | — |
| 0.15 | 500 | 9.80 | 23.14 | 59.21 | 18.73 | 87.1 |
| 0.2 | 610 | 9.29 | 21.30 | 53.40 | 17.44 | — |

TABLE 14

(twist angle 59°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | 11.16 | 27.63 | 67.92 | 21.66 | 87.6 |
| 0.1 | 400 | 10.20 | 24.17 | 60.71 | 19.47 | — |
| 0.15 | 500 | 9.80 | 22.62 | 57.79 | 18.52 | 87.1 |
| 0.2 | 610 | 9.52 | 22.14 | 56.62 | 18.04 | — |

TABLE 15

(twist angle 60°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|
| 0.06 | 300 | unmeasurable | unmeasurable | unmeasurable | unmeasurable | — |
| 0.1 | 400 | unmeasurable | unmeasurable | unmeasurable | unmeasurable | — |
| 0.15 | 500 | unmeasurable | unmeasurable | unmeasurable | unmeasurable | — |
| 0.2 | 610 | unmeasurable | unmeasurable | unmeasurable | unmeasurable | — |

As can be seen from the data obtained from the prototype models described above, the twist angle β of the shaping air SA-IN is preferably 56 degrees to 59 degrees, and more preferably 56 degrees to 58 degrees.

FIG. 6 shows a relationship between the twist angle of the shaping air SA-IN and the atomization of paint particles. FIG. 6 was created in examining the relationship between the twist angle β of the shaping air SA-IN and the atomization of paint particles by organizing collected data. The rotational speed of the bell cup 10 was 25,000 rpm. Also, the paint discharge rate (flow rate) was 600 cc/min. Those skilled in the art can see the following from the data illustrated in FIG. 6. That is, the larger the twist angle β, the smaller the paint particles tend to become.

FIG. 7 shows a relationship between the twist angle β of the shaping air SA-IN and coating efficiency. FIG. 7 was created in examining the twist angle β of the shaping air SA-IN and the coating efficiency by organizing collected data. The rotational speed of the bell cup 10 was 25,000 rpm. Also, the paint discharge rate was 600 cc/min. Those skilled in the art can see the following from the data illustrated in FIG. 7. That is, when the twist angle β of the shaping air SA-IN is set at an angle of 55 degrees or more and less 59 degrees, the coating efficiency becomes much higher than approximately 85%, which is the conventional efficiency.

FIG. 8 is a diagram created in checking whether a high coating efficiency can be achieved in a low-rpm region in which the rotational speed of the bell cup 10 is lower than in conventional applicators. FIG. 8 was created by organizing collected data under conditions of equal average paint particle diameter (the average particle diameter of paint was 20.5 μm). The paint discharge rate was 600 cc/min. The twist angle β of the shaping air SA-IN was 57 degrees.

FIG. 8 shows the following.

(1) When the discharge pressure of the shaping air SA-IN was 0.03 MPa and the rotational speed of the bell cup 10 was 25,000 rpm, the coating efficiency was 91.6%.

(2) When the discharge pressure of the shaping air SA-IN was 0.06 MPa and the rotational speed of the bell cup 10 was 22,500 rpm, the coating efficiency was 89.5%.

(3) When the discharge pressure of the shaping air SA-IN was 0.09 MPa and the rotational speed of the bell cup 10 was 20,000 rpm, the coating efficiency was 91.4%.

(4) When the discharge pressure of the shaping air SA-IN was 0.12 MPa and the rotational speed of the bell cup 10 was 17,500 rpm, the coating efficiency was 91.3%.

(5) When the discharge pressure of the shaping air SA-IN was 0.15 MPa and the rotational speed of the bell cup 10 was 15,000 rpm, the coating efficiency was 91.6%.

By referring to FIG. 8, those skilled in the art will be surprised to see that higher coating efficiency was achieved even though the bell cup 10 had lower rotational speed and the paint discharge rate was higher than in conventional applicators.

The rotary atomizing electrostatic applicator illustrated in FIG. 9 is a comparative example. The electrostatic applicator 1 illustrated in FIG. 9 is a typical rotary atomizing applicator used today. The back angle of the bell cup 2 is 40 degrees. An axial distance between a shaping air ring 3 and an outer circumferential edge of a bell cup 2 is 22.86 mm. An axial distance between a point P hit by the shaping air SA-IN and the outer circumferential edge of the bell cup 2 is 2.4 mm.

When attention is paid to one of atomization air, i.e., to one of the shaping air SA-IN, the distance $L_0$ traveled by the shaping air SA-IN before hitting the bell cup 2 is 26.7 mm. The distance L is referred to as an "air travel distance."

The length of the air travel distance L influences the effect of the shaping air SA-IN in cutting the liquid threads. A long air travel distance L results in a reduction in the momentum of the shaping air SA-IN reaching the back of the bell cup. When the shaping air SA-IN is weak, the force of cutting the liquid threads is weak as well. This has a negative effect on the atomization of paint particles.

It is assumed that in the rotary atomizing electrostatic applicator 1 illustrated in FIG. 9, the twist angle β of shaping air SA-IN is set within a range of 50 degrees or more and less than 60 degrees. In this case, by setting the twist angle β within a range of 50 degrees or more and less than 60 degrees, it is possible to atomize paint particles. However, when the twist angle β is increased, the air travel distance L is increased as well. When the air travel distance L is increased, the liquid-thread cutting force of the shaping air SA-IN becomes weak.

To solve this problem, it is advisable to set the axial distance between the shaping air ring 3 and the outer circumferential edge of the bell cup 2, such that the air travel distance L will be equal to the conventional air travel distance $L_0$ (26.7 mm). If the air travel distance L is set equal to the conventional one, theoretically the same resistance as conventional one is applied to the shaping air SA-IN from the ambient environment. This makes it possible to enjoy an advantage of setting the twist angle β within a range of 50 degrees or more and less than 60 degrees, i.e., atomization of paint particles.

When the axial distance between the shaping air ring 3 and the outer circumferential edge of the bell cup 2 is set such that the air travel distance L will be smaller than the conventional air travel distance $L_0$ (26.7 mm), the resistance of the ambient environment can be reduced. That is, the shaping air SA-IN with a sufficiently large momentum can be caused to hit the liquid threads. Therefore, when the discharge pressure and/or flow rate of the shaping air SA-IN are/is set equal to the conventional one(s), the cutting force of the shaping air SA-IN can be increased in cutting the liquid threads. Consequently, paint particles can be further atomized.

If the particle diameter of paint particles is permitted to be equal to the conventional one, the discharge pressure and/or flow rate of the shaping air SA-IN can be set smaller than the conventional value(s). This makes it possible to weaken the force of the shaping air SA-IN tending to direct paint particles forward. Also, the rotational speed of the bell cup can be set to a value lower than the conventional one. Also, a bell cup with a small diameter can be adopted. This allows the centrifugal force acting on paint particles to be reduced. If the centrifugal force acting on paint particles is small, the force used to direct the paint particles forward may be small. This means that the width of the painting pattern (diameter of the painting pattern) can be controlled easily.

To control the painting pattern width, additional shaping air SA-OUT may be provided on an outer circumference of the shaping air SA-IN described above. The painting pattern width can be controlled by turning on and off the additional shaping air SA-OUT or controlling the discharge pressure and/or discharge flow rate of the additional shaping air SA-OUT. That is, the additional shaping air SA-OUT has a function to control the painting pattern width and direct atomized paint particles at the object to be painted. To achieve this function, the additional shaping air SA-OUT may be minimum of air. As a variation, in controlling the painting pattern width, the discharge pressure and/or discharge flow rate of the above-mentioned shaping air SA-IN may be controlled additionally.

The above-mentioned air travel distance L varies in optimum value with the diameter of the bell cup 10, and when the diameter of the bell cup 10 is approximately 70 mm to 77 mm, the air travel distance L is 30 mm to 1 mm, preferably 15 mm to 1 mm, and most preferably 10 mm to 1 mm.

FIG. 10 shows a prototype model whose air travel distance L is set at 8.63 mm (L=8.63 mm). In the prototype model illustrated in FIG. 10, the diameter of the bell cup 10 is 77 mm. The axial distance between the outer circumferential edge of the bell cup 10 and a shaping air ring 12 is 12.4 mm and the axial distance between the point at which the shaping air SA-IN hits the bell cup 10 and outer circumferential edge of the bell cup is 7.7 mm. The twist angle of shaping air SA-IN is 57 degrees. Data on the prototype model illustrated in FIG. 10 is shown in Table 16 below. Good results were obtained as can be seen from Table 16.

Painting conditions were as follows.

(1) High voltage: −80 kV (2) Paint discharge rate (flow rate): 600 cc/min (3) Rotational speed of bell cup: 25,000 rpm (4) Painting speed (gun speed): 350 mm/sec (5) Painting distance (gun distance): 200 mm

TABLE 16

(twist angle 57°)

| SA-IN air pressure (MPa) | SA-IN flow rate (NL/min) | particle diameter of paint particle in d10 (μm) | particle diameter of paint particle in d50 (μm) | particle diameter of paint particle in d90 (μm) | sauter mean diameter of paint particle (μm) |
|---|---|---|---|---|---|
| 0.03 | 180 | 10.08 | 24.76 | 62.44 | 19.58 |
| 0.06 | 260 | 9.77 | 23.26 | 57.83 | 18.67 |
| 0.09 | 320 | 9.75 | 23.53 | 56.18 | 18.67 |
| 0.12 | 375 | 9.48 | 22.87 | 54.09 | 18.13 |
| 0.15 | 435 | 9.44 | 22.8 | 53.09 | 18.03 |

Those skilled in the art will be surprised at the numeric values of the mean diameter in relation to the numeric values of the shaping air SA-IN in Table 16. That is, it can be seen that the paint particles were sufficiently atomized even though the discharge pressure of the shaping air SA-IN was low. This means that the atomization performance of the electrostatic applicator has been improved markedly. This can be said even when the paint discharge rate is higher than is conventionally the case.

The rotary atomizing electrostatic applicator according to the present invention can atomize paint particles without using strong shaping air. As described above, it is known that to improve the quality of metallic painting, the velocity of collision of paint particles with automotive body surfaces can be increased, and based on this idea, strong shaping air is used in conventional rotary atomizing electrostatic applicators. The applicator according to the present invention can improve the quality of metallic painting by atomizing paint particles without using strong shaping air. Thus, the rotary atomizing electrostatic applicator according to the present invention can improve coating efficiency of metallic painting using weaker shaping air than in the case of conventional metallic painting. This can be said even when the paint discharge rate is higher than is conventionally the case.

BRIEF DESCRIPTION OF THE DRAWINGS

FIG. 4(I) is a side view of the bell cup and FIG. 4(II) is a sectional view taken along line 4(II)-4(II) in FIG. 4(I).

FIG. 5(I) is a side view of the bell cup and FIG. 5(II) is a sectional view taken along line 5(II)-5(II) in FIG. 5(I).

DETAILED DESCRIPTION OF THE PRESENT INVENTION

[Embodiment]

A preferred embodiment of the present invention will be described below with reference to the accompanying drawings.

Figure 1:
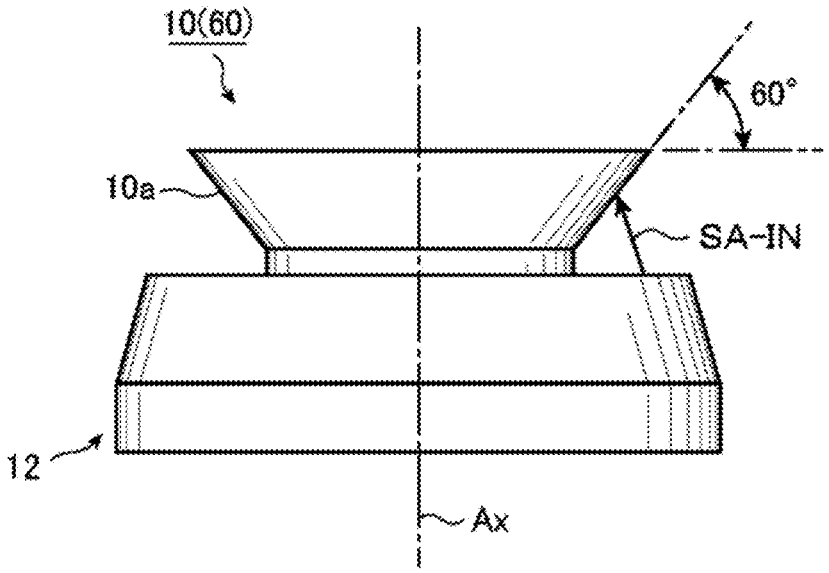
FIG. 1 shows a tip portion of a prototype electrostatic applicator, where the illustrated electrostatic applicator is equipped with a bell cup with a back angle of 60 degrees.
Figure 2:
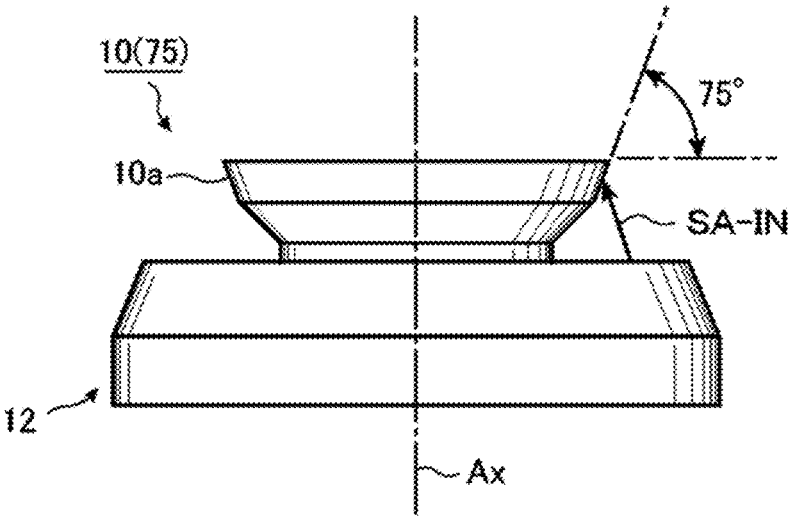
FIG. 2 shows a tip portion of a prototype electrostatic applicator, where the illustrated electrostatic applicator is equipped with a bell cup with a back angle of 75 degrees.
Figure 3:
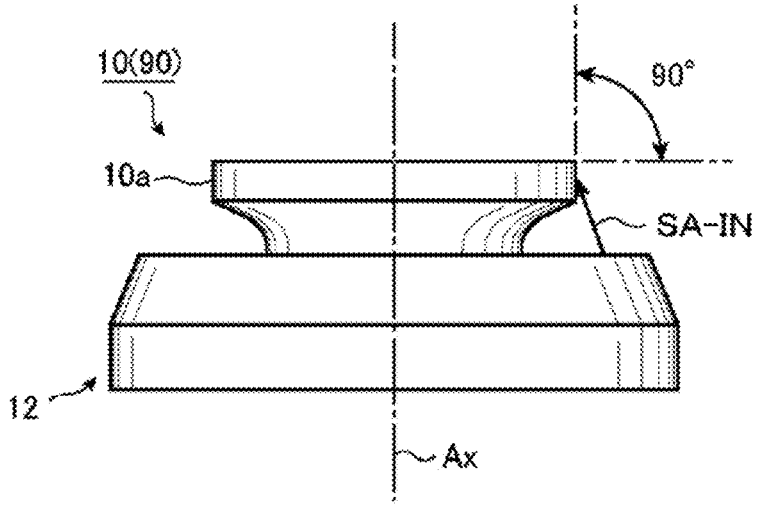
FIG. 3 shows a tip portion of a prototype electrostatic applicator, where the illustrated electrostatic applicator is equipped with a bell cup with a back angle of 90 degrees.
Figure 4:
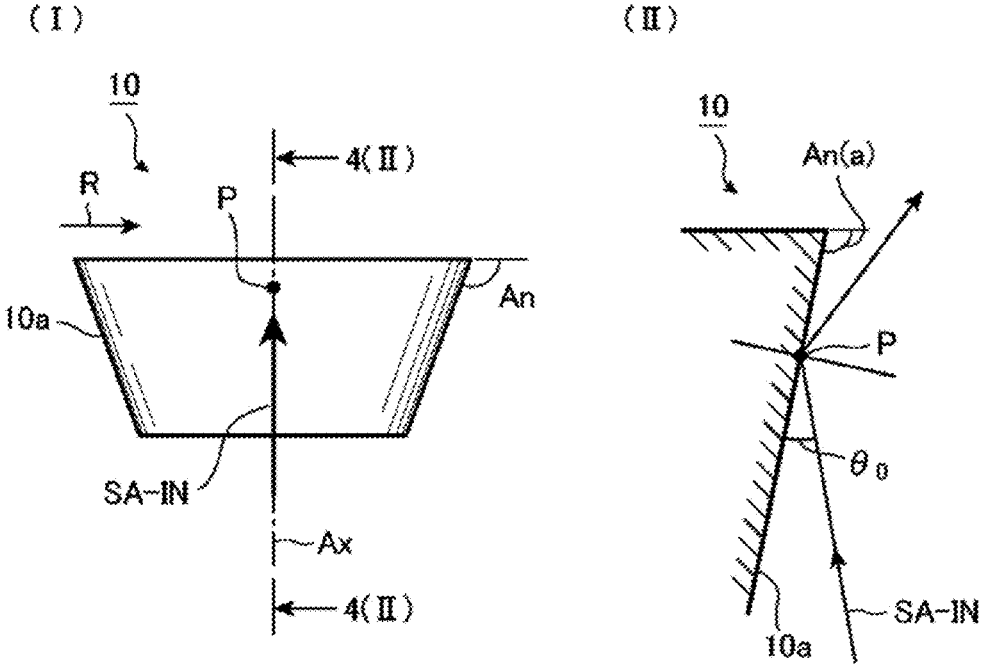
FIG. 4 illustrates, as a comparative example, an incident angle at which shaping air hits the back of a bell cup when a twist angle of the shaping air is zero, where
Figure 5:
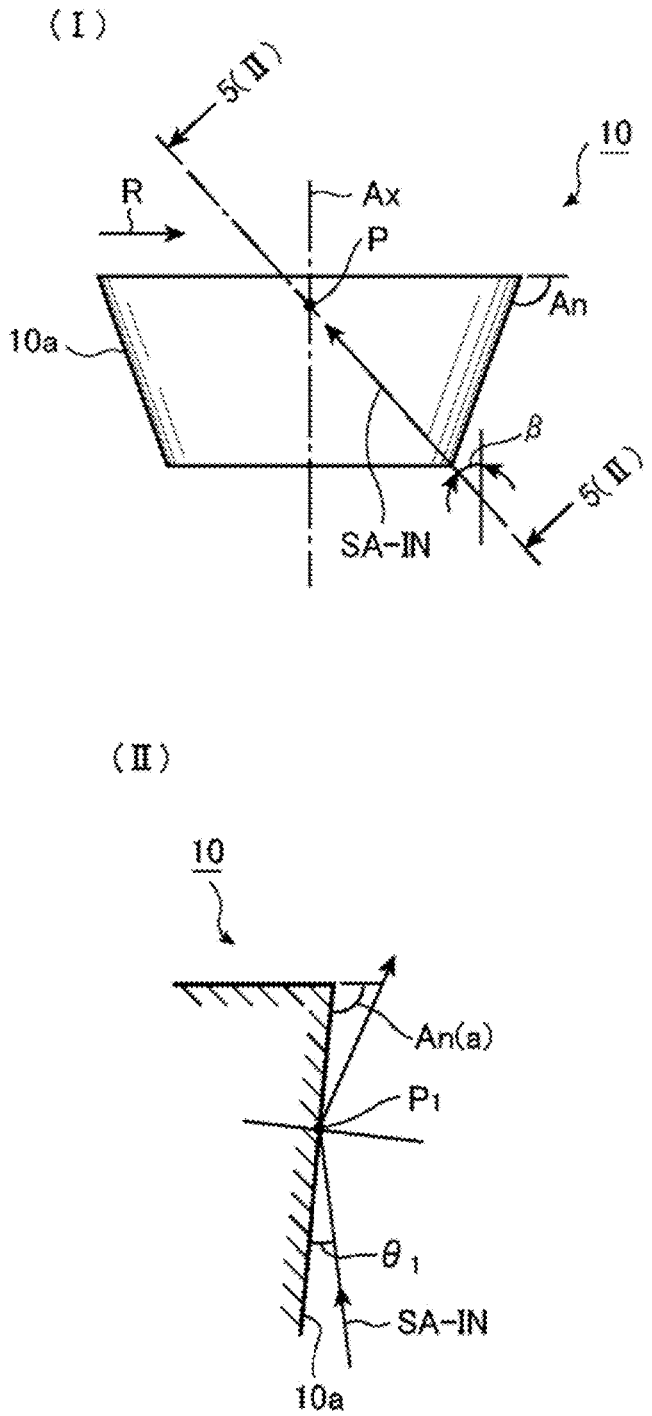
FIG. 5 illustrates how an incident angle at which shaping air hits the back of a bell cup becomes relatively small when the shaping air has a twist angle, where
Figure 6:
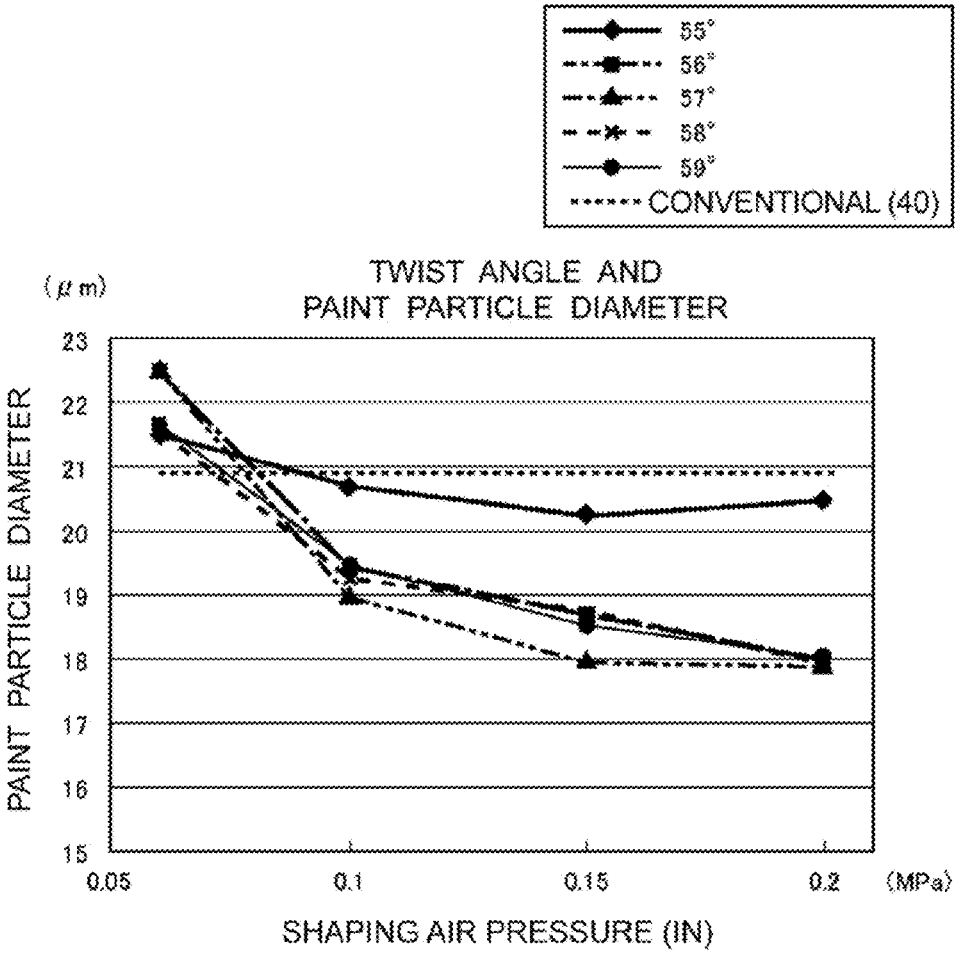
FIG. 6 shows a relationship between a twist angle β of shaping air SA-IN and atomization of paint particles.
Figure 7:
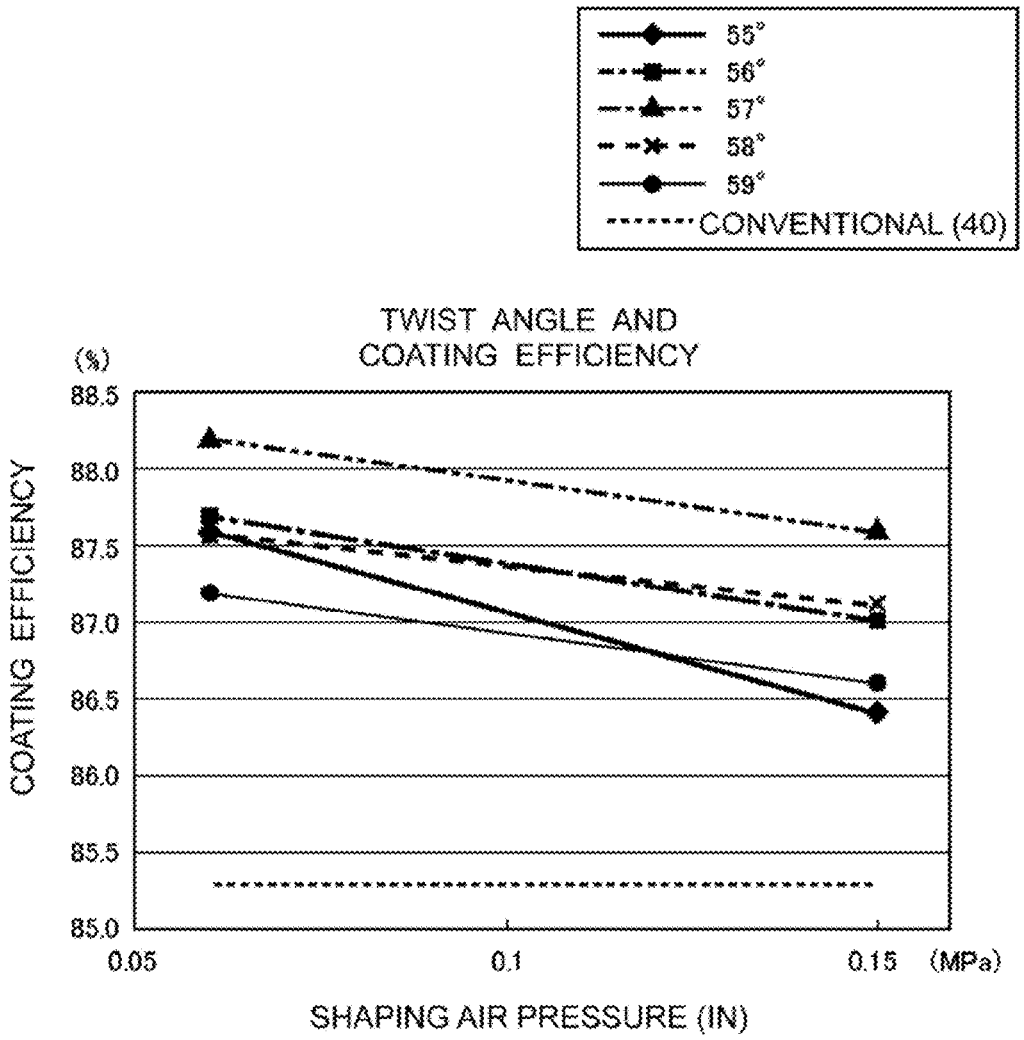
FIG. 7 shows a relationship between the twist angle β of the shaping air SA-IN and coating efficiency.
Figure 8:
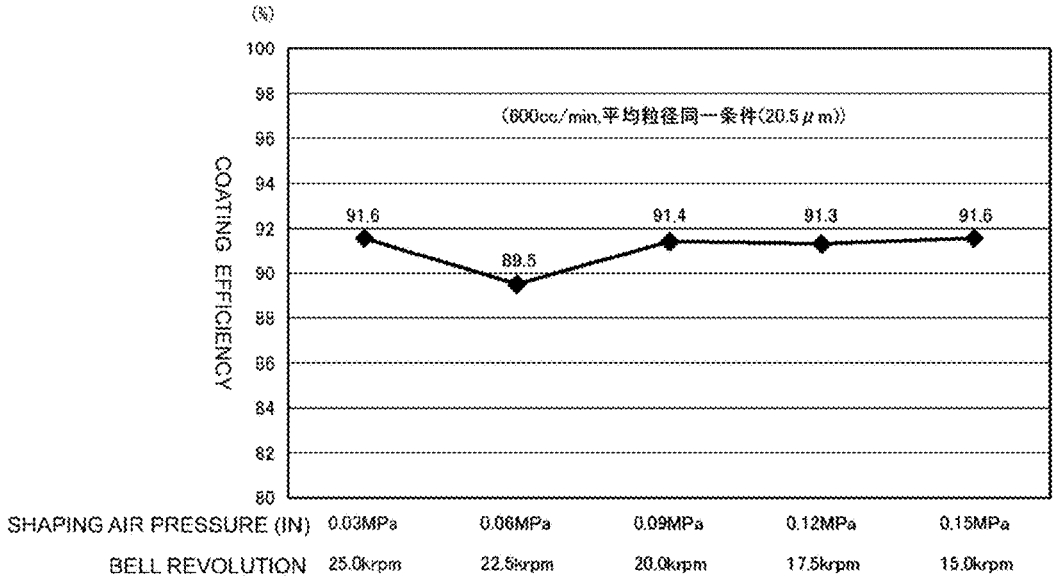
FIG. 8 is a diagram created to check whether a prototype applicator can achieve a high coating efficiency in a low-rpm region.
Figure 9:
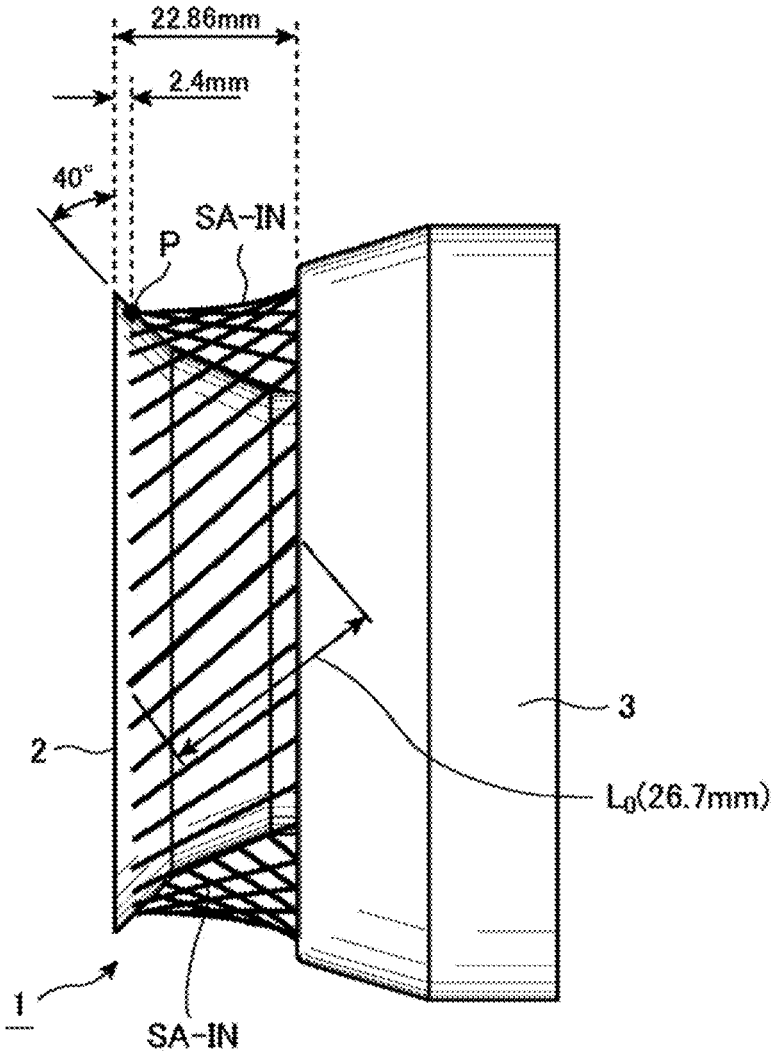
FIG. 9 shows a tip portion of a rotary atomizing electrostatic applicator according to a comparative example, where an air travel distance is $L_0$=26.7 mm.
Figure 10:
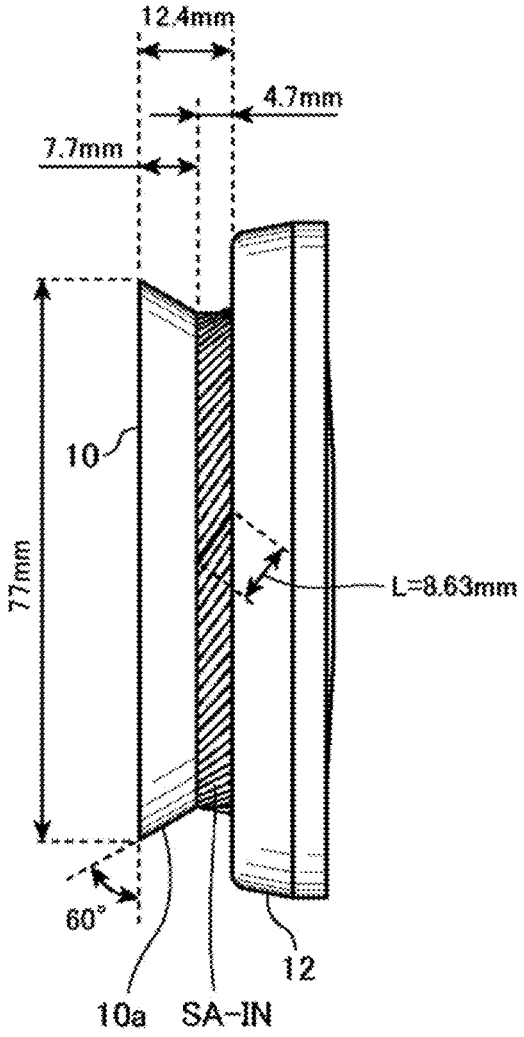
FIG. 10 shows a tip portion of a rotary atomizing electrostatic applicator with an air travel distance L of 8.63 mm.
Figure 11:
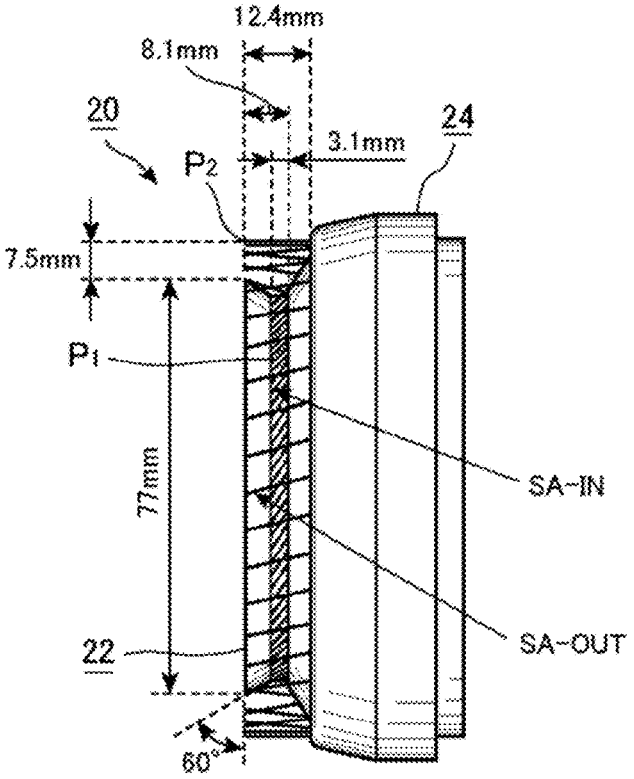
FIG. 11 shows a tip portion of an electrostatic applicator according to an embodiment of the present invention.

Rotary Atomizing Electrostatic Applicator According to the Embodiment (FIGS. 11 to 17):

FIG. 11 is a side view of a tip portion of the rotary atomizing electrostatic applicator according to the embodiment. The electrostatic applicator 20 illustrated in FIG. 11 includes a bell cup 22 and a shaping air ring 24. Diameter of the bell cup 22 is 77 mm. A back angle of a back 22*a* of the bell cup is 60 degrees.

Figure 12:
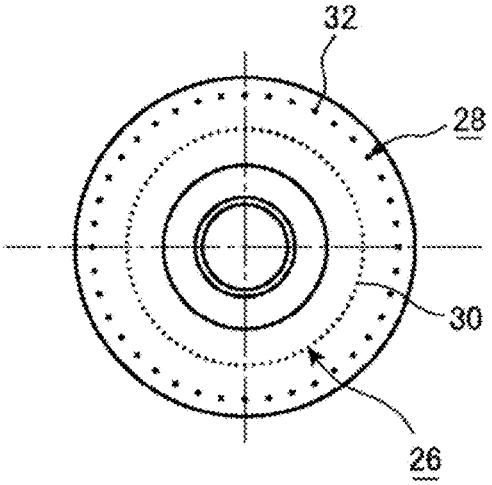
FIG. 12 is a front view of a shaping air ring included in the applicator of FIG. 11.

The shaping air ring 24 is positioned forward compared to a conventional one. FIG. 12 is a front view of the shaping air ring 24. The shaping air ring 24 has a first air discharge hole group 26 located on a first circumference (with a radius of 35.95 mm) centered around a rotation axis Ax of the bell cup 22 and a second air discharge hole group 28 located on a second circumference (with a radius of 46.1 mm) on an outer circumferential side thereof.

The first air discharge hole group 26 is made up of plural first air discharge holes 30 arranged at equal intervals. Air discharged through the first air discharge holes 30 is the shaping air SA-IN described earlier. The first air discharge holes 30 are referred to as "atomization air holes." The atomization air holes 30 are 0.5 mm in diameter. The number of atomization air holes 30 is "90."

The second air discharge hole group 28 is made up of plural second air discharge holes 32 arranged at equal intervals. The second air discharge holes 32 are referred to as "pattern air holes." The pattern air holes 32 are 0.8 mm in diameter, larger than the atomization air holes 30. The number of pattern air holes 32 is "40," fewer than half the atomization air holes 30.

Air is fed to the atomization air holes 30 and pattern air holes 32 through independent channels. Therefore, the discharge pressure and flow rate of the first shaping air SA-IN discharged through the atomization air holes 30 and the discharge pressure and flow rate of the second shaping air SA-OUT discharged through the pattern air holes 32 can be controlled independently of each other.

Both first shaping air SA-IN and second shaping air SA-OUT have respectively a twist angle in the direction opposite to the rotation direction of the bell cup 22. That is, both atomization air holes 30 and pattern air holes 32 are configured to be holes inclined in the direction opposite to the rotation direction of the bell cup 22.

The first shaping air SA-IN discharged through the atomization air holes 30 is referred to as "atomization air." The atomization air SA-IN is oriented toward the back 22*a* of the bell cup 22. An axial distance between discharge ends of the atomization air holes 30 and collision points $P_1$ at which the atomization air SA-IN hits the back 22*a* of the bell cup is 3.1 mm. An axial distance between the collision points $P_1$ and an outer circumferential edge of the bell cup is 5 mm. The collision points $P_1$ of the atomization air SA-IN discharged through the respective atomization air holes 30 are set at equal intervals on a same circumference on the back 22*a* of the bell cup 22. The twist angle of the atomization air (shaping air SA-IN) is 57 degrees.

The second shaping air SA-OUT discharged through the pattern air holes 32 is referred to as "pattern air." The pattern air SA-OUT is oriented toward points $P_2$ 7.5 mm away from an outer circumferential edge of the bell cup 22. That is, the pattern air SA-OUT is directed at the points $P_2$ 7.5 mm away from the outer circumferential edge of the bell cup 22 on a plane including the outer circumferential edge of the bell cup 22.

An axial distance between discharge ends of the pattern air holes 32 and the points $P_2$ reached by the pattern air on the plane including the outer circumferential edge of the bell cup 22 is 12.4 mm. The points $P_2$ reached by the pattern air discharged through the pattern air holes 32 are set at equal intervals on a same circumference on the plane including the outer circumferential edge of the bell cup 22. A twist angle of the pattern air SA-OUT is 15 degrees.

An axial distance between the air discharge ends of the atomization air holes 30 and the plane including the outer circumferential edge of the bell cup 22 is 8.1 mm. An axial distance between the air discharge ends of the pattern air holes 32 and the plane including the outer circumferential edge of the bell cup 22 is 12.4 mm. A front face of the shaping air ring 24 is configured as a stepped face. That is, the front face of the shaping air ring 24 is shaped to protrude forward on an inner circumferential side. The atomization air holes 30 open in an inner circumferential portion protruding forward. An axial distance between the inner circumferential portion protruding forward and the plane including the outer circumferential edge of the bell cup 22 is 8.1 mm. On the other hand, the pattern air holes 32 open in an outer circumferential portion located relatively rearward of the inner circumferential portion. An axial distance between the outer circumferential portion and the plane including the outer circumferential edge of the bell cup 22 is 12.4 mm.

Data of the rotary atomizing electrostatic applicator equipped with the bell cup 22 and shaping air ring 24 illustrated in FIG. 11 is shown in Table 17 below.

Painting conditions were as follows.

(1) High voltage: −80 kV
(2) Paint discharge rate: 600 cc/min
(3) Rotational speed of bell cup: 20,000 rpm
(4) Painting speed (gun speed): 350 mm/sec
(5) Painting distance (gun distance): 200 mm

TABLE 17

| SA-IN air pressure (MPa) | SA-IN flow rate (NL/min) | SA-OUT air pressure (MPa) | SA-OUT flow rate (NL/min) | particle diameter of paint particle in d10 (μm) | particle diameter of paint particle in d50 (μm) | particle diameter of paint particle in d90 (μm) | sauter mean diameter of paint particle (μm) | coating efficiency (%) |
|---|---|---|---|---|---|---|---|---|
| 0.12 | 375 | 0.01 | 150 | 7.9 | 24.4 | 51.1 | 16.4 | 90.2 |
| 0.15 | 425 | 0.01 | 150 | 7.4 | 23.6 | 51.0 | 15.8 | 90.3 |
| 0.12 | 375 | 0.02 | 175 | 8.0 | 24.8 | 51.5 | 16.6 | — |
| 0.15 | 425 | 0.02 | 175 | 7.5 | 23.9 | 51.4 | 15.9 | — |
| 0.12 | 375 | 0.03 | 210 | 7.9 | 24.9 | 51.7 | 16.6 | — |
| 0.15 | 425 | 0.03 | 210 | 7.5 | 24.3 | 52.0 | 16.0 | — |

The following test was conducted to verify the performance of the rotary atomizing electrostatic applicator 20 according to the embodiment.

Figure 13:
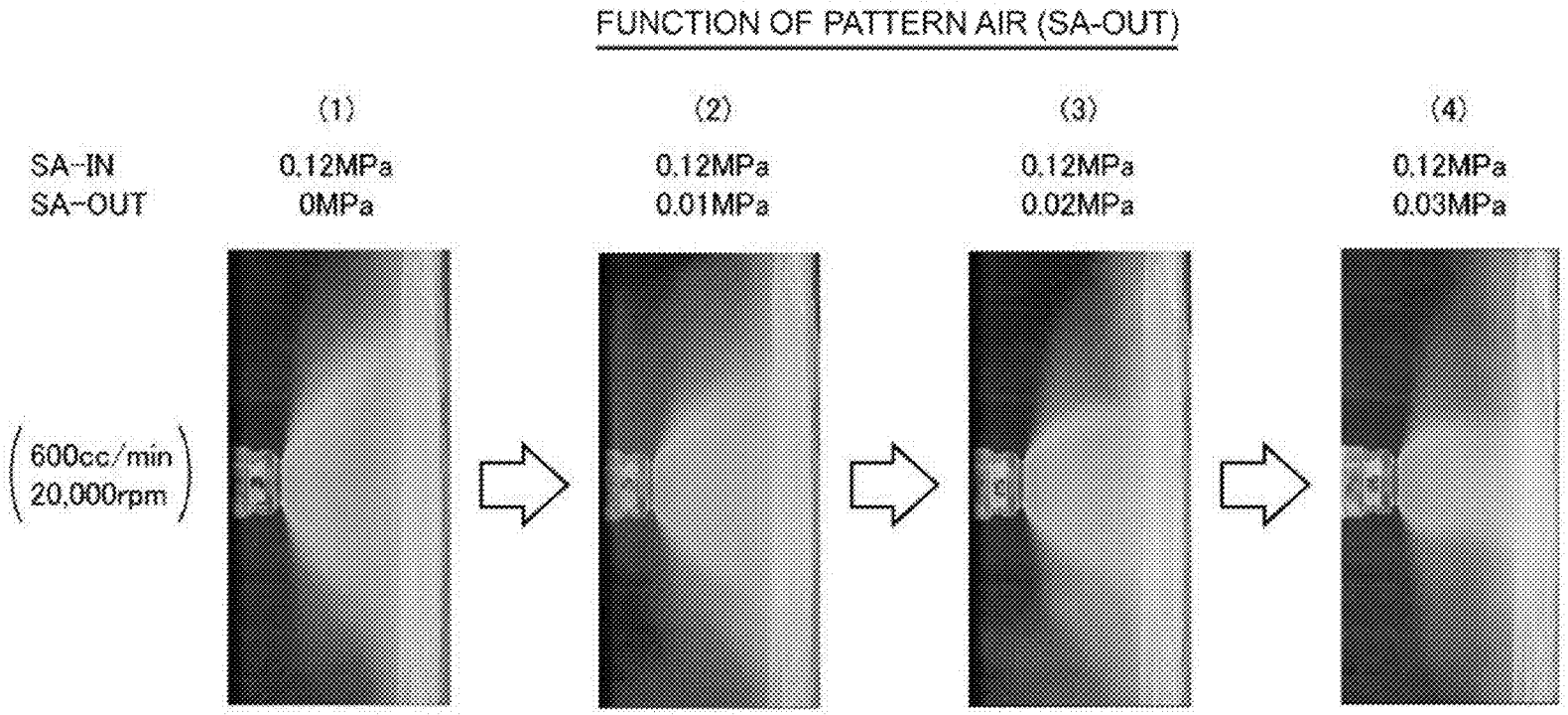
FIG. 13 shows painting pattern control capacity of the applicator according to the embodiment (a paint discharge rate is 600 cc/min).

When the paint discharge rate was great (600 cc/min), the ability to control a painting pattern width (diameter of a pattern) was tested, and good results were obtained as shown in Table 18 below and FIG. 13.

Painting conditions were as follows.

(1) High voltage: −80 kV
(2) Paint discharge rate: 600 cc/min
(3) Rotational speed of bell cup: 20,000 rpm
(4) Painting speed (gun speed): 350 mm/sec
(5) Painting distance (gun distance): 200 mm

TABLE 18

| | (1) | (2) | (3) | (4) |
|---|---|---|---|---|
| paint flow rate (cc/min) | 600 | 600 | 600 | 600 |
| air pressure at pattern air hole 32 (MPa) | 0 | 0.01 | 0.02 | 0.03 |
| air flow rate at pattern air hole 32 (NL/min) | 0 | 150 | 175 | 210 |

TABLE 18-continued

| | (1) | (2) | (3) | (4) |
|---|---|---|---|---|
| air pressure at atomization air hole 30 (MPa) | 0.12 | 0.12 | 0.12 | 0.12 |
| air flow rate at atomization air hole 30 (NL/min) | 375 | 375 | 375 | 375 |
| painting pattern width (diameter: mm) | 700 | 450 | 350 | 300 |
| rotational speed of bell cup 22 (rpm) | 20,000 | 20,000 | 20,000 | 20,000 |
| coating efficiency (%) | — | 90.2 | — | — |

Next, by setting a maximum paint discharge rate at 750 cc/min to 300 cc/min, the capacity to control the paint discharge rate was tested with the painting pattern width kept constant and results are shown in Table 19 below.

TABLE 19

| | | | | |
|---|---|---|---|---|
| painting pattern width (diameter: mm) | 450 | 450 | 450 | 450 |
| paint discharged rate (cc/min) | 750 | 600 | 450 | 300 |
| air pressure at pattern air hole 32 (MPa) | 0.01 | 0.01 | 0.01 | 0.01 |
| air flow rate at pattern air hole 32 (NL/min) | 150 | 150 | 150 | 150 |
| air pressure at atomization air hole 30 (MPa) | 0.12 | 0.1 | 0.08 | 0.05 |
| air flow rate at atomization air hole 30 (NL/min) | 375 | 330 | 290 | 225 |
| rotational speed of bell cup 22 (rpm) | 20,000 | 20,000 | 20,000 | 20,000 |

Next, when the paint discharge rate was relatively small (200 cc/min), the ability to control the painting pattern width (diameter of a pattern) was tested, and good results were obtained as shown in Table 20 below.

TABLE 20

| | | | | |
|---|---|---|---|---|
| paint discharged rate (flow rate: cc/min) | 200 | 200 | 200 | 200 |
| air pressure at pattern air hole 32 (MPa) | 0.08 | 0.1 | 0.12 | 0.15 |
| air flow rate at pattern air hole 32 (NL/min) | 420 | 465 | 510 | 575 |
| air pressure at atomization air hole 30 (MPa) | 0.05 | 0.05 | 0.05 | 0.05 |
| air flow rate at atomization air hole 30 (NL/min) | 225 | 225 | 225 | 225 |
| pattern width (diameter: mm) | 300 | 250 | 220 | 200 |
| rotational speed of bell cup 22 (rpm) | 20,000 | 20,000 | 20,000 | 20,000 |
| coating efficiency (%) | — | 90.9 | — | 90.2 |

Figure 14:
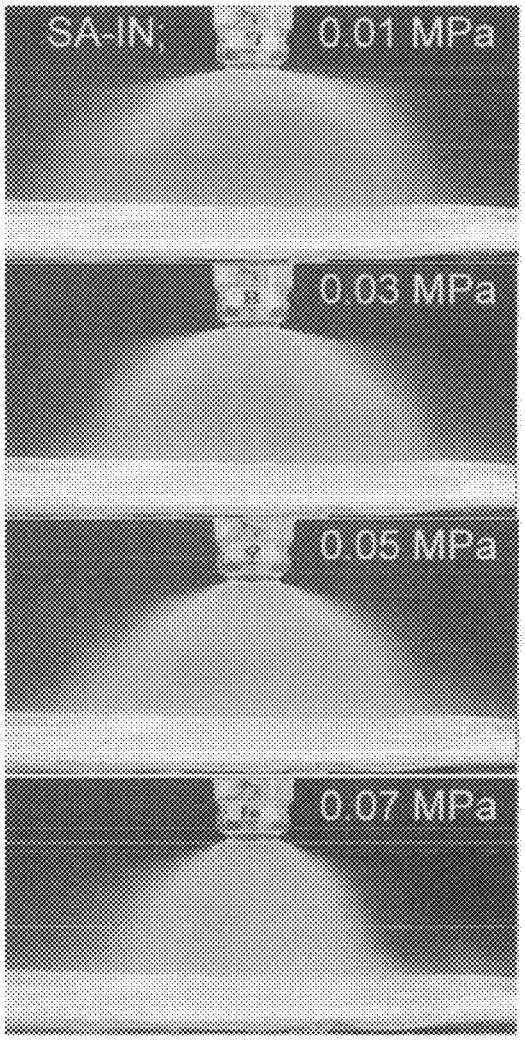
FIG. 14 shows painting pattern control capacity of the applicator according to the embodiment when the paint discharge rate is set to 200 cc/min and only discharge pressure of atomization air (first shaping air SA-IN) is varied.

FIG. 14 shows how controllability of the painting pattern width is checked by changing only the air discharge pressure (MPa) at the atomization air holes 30 with the paint discharge rate (flow rate) set at 200 cc/min. Part (1) of FIG. 14 shows a state of spray produced when the air discharge pressure at the atomization air holes 30 is 0.01 MPa. Part (2) of FIG. 14 shows a state of spray produced when the air discharge pressure at the atomization air holes 30 is 0.03 MPa. Part (3) of FIG. 14 shows a state of spray produced when the air discharge pressure at the atomization air holes 30 is 0.05 MPa. Part (4) of FIG. 14 shows a state of spray produced when the air discharge pressure at the atomization air holes 30 is 0.07 MPa.

Figure 15:
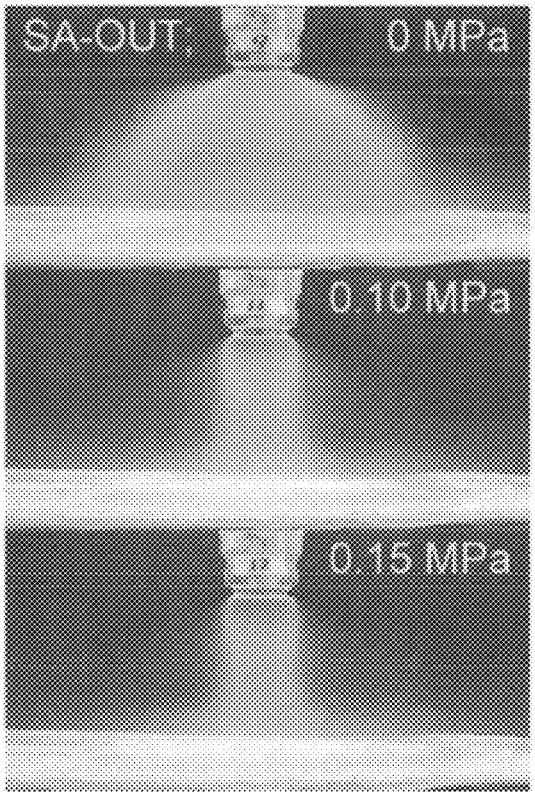
FIG. 15 shows painting pattern control capacity of the applicator according to the embodiment when the paint discharge rate is set to 200 cc/min and only discharge pressure of pattern air (second shaping air SA-OUT) is varied.

FIG. 15 shows how controllability of the painting pattern width is checked by changing only the air discharge pressure at the pattern air holes 32 with the paint discharge rate (flow rate) set at 200 cc/min. Part (1) of FIG. 15 shows a state of spray produced when the air discharge pressure at the pattern air holes 32 is 0 (zero) MPa. Part (2) of FIG. 15 shows a state of spray produced when the air discharge pressure at the pattern air holes 32 is 0.10 MPa. Part (3) of FIG. 15 shows a state of spray produced when the air discharge pressure at the pattern air holes 32 is 0.15 MPa.

As can be seen when FIG. 14 and FIG. 15 are compared, the atomization air SA-IN discharged through the atomization air holes 30 plays a minor role in controlling the painting pattern width. The pattern air SA-OUT discharged through the pattern air holes 32 contributes greatly to controlling the painting pattern width.

Next, by setting the paint discharge rate to a low level (low flow rate) (150 cc/min to 250 cc/min), the capacity to control the paint discharge rate was tested with the painting pattern width kept constant and results are shown in Table 21 below.

TABLE 21

| | | | |
|---|---|---|---|
| pattern width (diameter: mm) | 220 | 220 | 220 |
| paint discharged rate (flow rate) (cc/min) | 150 | 200 | 250 |
| air pressure at pattern air hole 32 (MPa) | 0.12 | 0.12 | 0.12 |
| air flow rate at pattern air hole 32 (NL/min) | 510 | 510 | 510 |
| air pressure at atomization air hole 30 (MPa) | 0.03 | 0.05 | 0.08 |
| air flow rate at atomization air hole 30 (NL/min) | 150 | 235 | 290 |
| rotational speed of bell cup 22 (rpm) | 20,000 | 20,000 | 20,000 |

Figure 16:
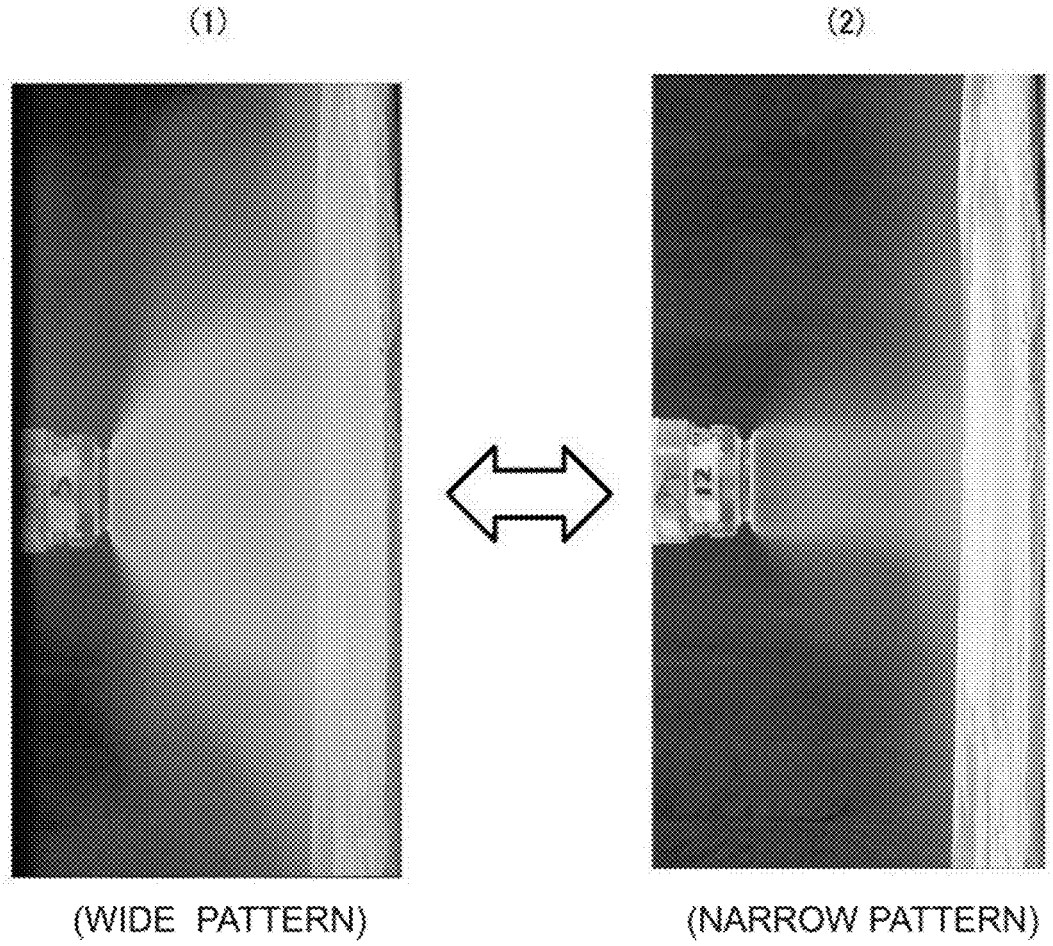
FIG. 16 shows how the applicator according to the embodiment can change the paint discharge rate greatly between 600 cc/min and 200 cc/min and vary a painting pattern width.

FIG. 16 shows results obtained by changing the paint discharge rate (flow rate) greatly between 600 cc/min and 200 cc/min and varying the painting pattern width. Painting conditions in Part (1) of FIG. 16 were as follows.

(i) Paint discharge rate (flow rate): 600 cc/min;

(ii) Rotational speed of bell cup 22: 20,000 rpm;

(iii) Discharge pressure at atomization air holes 30: 0.12 MPa (flow rate: 375 NL/min);

(iv) Discharge pressure at pattern air holes 32: 0.01 MPa (flow rate: 150 NL/min).

The painting pattern width (pattern diameter) at a paint discharge rate of 600 cc/min in Part (1) of FIG. 16 was 470 mm. Also, the average particle diameter of paint particles was 19.9 μm.

Painting conditions in Part (2) of FIG. 16 were as follows.

(i) Paint discharge rate (flow rate): 200 cc/min;

(ii) Rotational speed of bell cup 22: 20,000 rpm;

(iii) Discharge pressure at atomization air holes 30: 0.05 MPa (flow rate: 225 NL/min);

(iv) Discharge pressure at pattern air holes 32: 0.15 MPa (flow rate: 575 NL/min).

The painting pattern width (pattern diameter) at a paint discharge rate of 200 cc/min in Part (2) of FIG. 16 was 220 mm. Also, the average particle diameter of paint particles was 16.6 μm.

Figure 17:
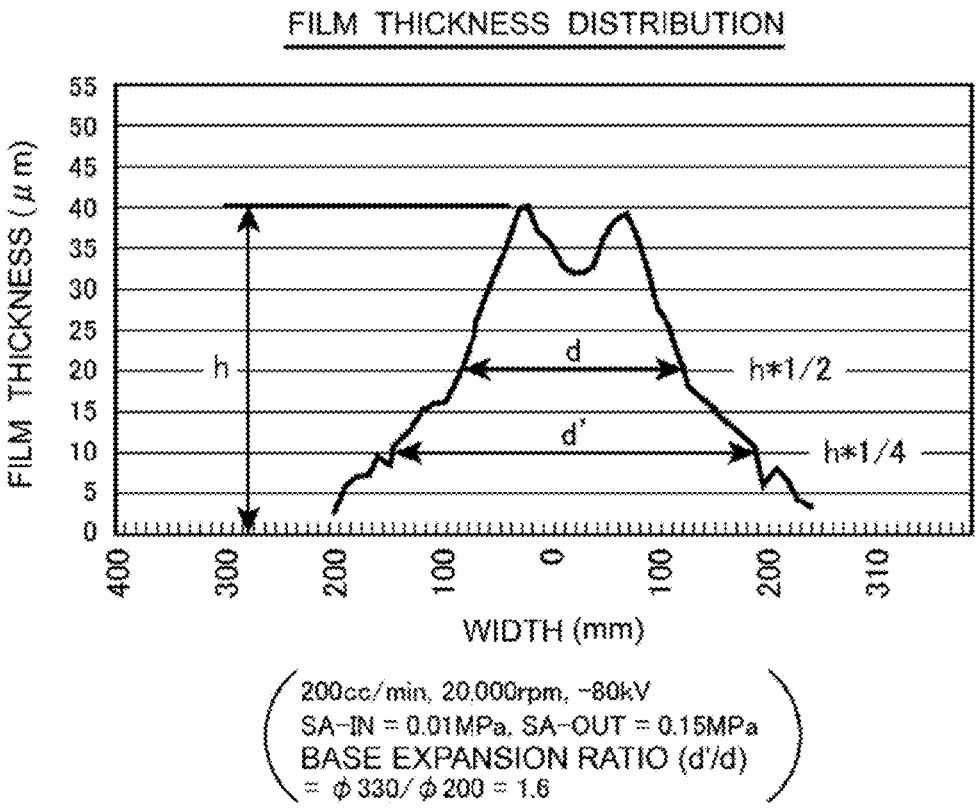
FIG. 17 shows a film thickness distribution of a paint film produced when painting was done by the applicator according to the embodiment.

FIG. 17 shows a film thickness distribution of a paint film produced when painting was done by the applicator 20 according to the embodiment (maximum film thickness: 40 μm). Painting conditions were as follows.

(i) Paint discharge rate (flow rate): 200 cc/min;

(ii) Rotational speed of bell cup (Bell revolution) 22: 20,000 rpm;

(iii) Discharge pressure at atomization air holes 30: 0.01 MPa (flow rate: 110 NL/min);

(iv) Discharge pressure at pattern air holes 32: 0.15 MPa (flow rate: 575 NL/min);

(v) Applied voltage to bell cup 22: −80 kV.

Referring to FIG. 17, a range (d) in which the film thickness was 20 μm or more had a diameter of 200 mm. A range (d') in which the film thickness was 10 μm or more had a diameter of 330 mm. A base expansion ratio is (d'/d)=330/200=1.6. The value "1.6" is an extremely good value compared with conventional ones. Incidentally, with conventional applicators, generally the base expansion ratio is (d'/d)=3.2.

REFERENCE SIGNS LIST

20 Rotary atomizing electrostatic applicator according to embodiment
10, 22 Bell cup
10*a*, 22*a* Back of bell cup
24 Shaping air ring
30 First air discharge hole (atomization air hole)
32 Second air discharge hole (pattern air hole)
SA-IN Shaping air (atomization air)
SA-OUT Pattern air
P Point at which shaping air SA-IN hits back of bell cup

What is claimed is:

1. A rotary atomizing electrostatic applicator comprising:

a bell cup whose back is hit by atomization air, an angle of the back with respect to a plane of an outer circumferential edge of the bell is 90 degrees or less;

first air holes adapted to discharge the atomization air directed at the back of the bell cup; and second air holes arranged on an outer circumferential side of the first air holes and configured to discharge a pattern air, wherein the first air holes are arranged at equal intervals on a circumference centered around a rotation axis of the bell cup, and the first air holes are oriented in a direction opposite to a rotation direction of the bell cup, wherein the bell cup is configured to rotate in a first direction about an axis of rotation thereof, wherein the atomization air discharged through the first air holes is twisted in a second direction opposite to the first direction at a twist angle, wherein the twist angle is the angle of atomization air discharged through the first air holes twisted in the second direction, and the twist angle of the atomization air is 50 degrees or more and less than 60 degrees, and wherein the pattern air discharged through the second air holes passes radially outward of an outer circumferential edge of the bell cup.

2. The rotary atomizing electrostatic applicator according to claim 1, wherein the twist angle of the atomization air is 56 degrees to 59 degrees.

3. The rotary atomizing electrostatic applicator according to claim 1, wherein the twist angle of the atomization air is 56 degrees to 58 degrees.

4. The rotary atomizing electrostatic applicator according to claim 1, wherein an air travel distance covered by the atomization air traveling from the first air holes to the back of the bell cup is equal to or smaller than 26.7 mm.

5. The rotary atomizing electrostatic applicator according to claim 1, wherein an air travel distance covered by the atomization air traveling from the first air holes to the back of the bell cup is 30 mm to 1 mm.

6. The rotary atomizing electrostatic applicator according to claim 1, wherein an air travel distance covered by the atomization air traveling from the first air holes to the back of the bell cup is 15 mm to 1 mm.

7. The rotary atomizing electrostatic applicator according to claim 1, wherein an air travel distance covered by the atomization air traveling from the first air holes to the back of the bell cup is 10 mm to 1 mm.

8. The rotary atomizing electrostatic applicator according to claim 1, wherein a discharge pressure of the atomization air discharged through the first air holes is 0.03 to 0.2 MPa.

9. The rotary atomizing electrostatic applicator according to claim 1, wherein a discharge pressure of the atomization air discharged through the first air holes is 0.03 to 0.15 MPa.

10. The rotary atomizing electrostatic applicator according to claim 8, wherein a discharge rate of the atomization air is 180 to 435 NL/min.

11. The rotary atomizing electrostatic applicator according to claim 1, wherein a maximum paint discharge rate is 1,000 cc/min to 300 cc/min.

12. The rotary atomizing electrostatic applicator according to claim 1, wherein the pattern air is twisted in the direction opposite to the rotation direction of the bell cup.

13. The rotary atomizing electrostatic applicator according to claim 12, wherein the first air holes are smaller in diameter than the second air holes.

14. The rotary atomizing electrostatic applicator according to claim 12, wherein the first air holes are larger in number than the second air holes.

15. The rotary atomizing electrostatic applicator according to claim 14, wherein the number of the first air holes is twice the number of the second air holes or more.

16. The rotary atomizing electrostatic applicator according to claim 1, wherein when the rotary atomizing electrostatic applicator is viewed from a side, the first air holes are positioned at positions close to the bell cup and the second air holes are positioned at positions away from the bell cup.

17. The rotary atomizing electrostatic applicator according to claim 1, wherein a rotational speed of the bell cup is 25,000 to 15,000 rpm.

18. A shaping air ring applied to the rotary atomizing electrostatic applicator according to claim 1, comprising the first air holes.

19. A shaping air ring applied to the rotary atomizing electrostatic applicator according to claim 1, comprising the first air holes and the second air holes.

* * * * *